United States Patent [19]

Swenson

[11] Patent Number: 4,939,883

[45] Date of Patent: Jul. 10, 1990

[54] SPACER FOR REINFORCING MESH AND SPIRAL REINFORCEMENT CAGES

[76] Inventor: Richard A. Swenson, 760 Norman Dr., Ridgewood, N.J. 07450

[21] Appl. No.: 438,981

[22] Filed: Nov. 20, 1989

Related U.S. Application Data

[63] Continuation of Ser. No. 215,411, Jul. 5, 1988, abandoned.

[51] Int. Cl.[5] ..... E04C 5/18

[52] U.S. Cl. ..... 52/686; 52/652; 52/677; 52/687

[58] Field of Search ..... 52/712, 719, 677, 679, 52/684, 685, 686, 687, 688, 689, 652

[56] References Cited

U.S. PATENT DOCUMENTS

| | | | |
|---|---|---|---|
| 529,154 | 11/1894 | Banks | 52/719 |
| 918,716 | 4/1909 | Wedmore . | |
| 919,100 | 4/1909 | Wedmore | 52/652 |
| 1,132,735 | 3/1915 | Schoenthaler | 52/686 |
| 1,263,887 | 4/1918 | Hamilton | 52/719 |
| 1,498,595 | 6/1924 | Wedmore | 52/719 |
| 1,512,763 | 10/1924 | Holmgreen | 52/719 |
| 1,543,207 | 6/1925 | Erb et al. | 52/719 |
| 1,561,323 | 11/1925 | Gregg . | |
| 1,615,651 | 1/1927 | Reynolds et al. . | |
| 1,830,888 | 11/1931 | Ribb | 52/686 |
| 1,838,124 | 12/1931 | White | 52/719 |
| 1,858,465 | 5/1932 | Schmitt | 52/687 |
| 1,984,028 | 12/1934 | Macleod | 52/712 |
| 2,299,490 | 8/1942 | Newman . | |
| 3,257,767 | 6/1966 | Lassy | 52/652 |
| 3,359,019 | 12/1967 | Pinkney . | |
| 3,400,792 | 4/1969 | Schmidgall . | |
| 3,471,986 | 10/1969 | Swenson . | |
| 3,521,842 | 7/1970 | Opperthauser . | |
| 3,722,164 | 3/1973 | Schmidgall . | |
| 4,005,560 | 2/1977 | Simpson et al. . | |
| 4,152,256 | 5/1979 | Wennberg . | |
| 4,301,638 | 11/1981 | Schmidgall . | |
| 4,452,026 | 6/1984 | Tolliver . | |
| 4,641,991 | 2/1987 | Yaoita | 52/719 |

FOREIGN PATENT DOCUMENTS

| | | | |
|---|---|---|---|
| 677072 | 6/1939 | Fed. Rep. of Germany | 24/131 R |
| 526247 | 9/1940 | United Kingdom | 52/687 |

OTHER PUBLICATIONS

Superior Wire Catalogue, No. 49503, 1981, 1988.
Hawkeye Catalogue, No. 182.

*Primary Examiner*—Michael Safavi
*Attorney, Agent, or Firm*—Brumbaugh, Graves, Donohue & Raymond

[57] ABSTRACT

A spacer for welded-wire concrete reinforcement includes an upper pigtail portion, a central shank portion, and a lower hook portion. The lower section of the shank portion slopes outwardly and downwardly to define a nose-like spacing projection to position the wire reinforcement relative to the surface of the concrete mold. The spacing nose also serves as a handgrip for facilitating installation of the spacer on the wire reinforcement. The spacer requires only one pair of intersecting wires for installation and is adapted for use with all mesh spacings, including helical cages, and all wire sizes.

13 Claims, 2 Drawing Sheets

SPACER FOR REINFORCING MESH AND SPIRAL REINFORCEMENT CAGES

This application is a continuation of application Ser. No. 07/215,411, filed on Jul. 5, 1988, now abandoned.

BACKGROUND

Field of the Invention

The present invention relates to a spacer for concrete wire reinforcement and, more particularly, to a reinforcement spacer which is adapted for use with all mesh and cage spacings and wire gauges and which is readily installed by hand.

THE PRIOR ART

In the manufacture of reinforced concrete structures, such as concrete pipe, walls, slabs, and the like, it is important that the steel reinforcement, typically in the form of welded-wire mesh, be properly positioned in the cross section of the designed structure. Improper positioning of the reinforcement degrades the structural integrity of the unit and, in a severe case, can lead to structural failure. Moreover, as labor skill and costs are significant factors in the manufacture of reinforced concrete structures, it is also important that the positioning of the reinforcement be carried out in as simple and straightforward, yet accurate, a manner as possible. A number of efforts have been made in the past to develop techniques and equipment that facilitate the correct placement of the steel reinforcement. Such efforts, however, have not fully addressed the problems involved nor provided solutions for those problems.

One prior art device is described in the applicant's own prior U.S. Pat. No. 3,471,986, which issued on Oct. 14, 1969. In the '986 patent, a spring-steel spacer clips over a pair of parallel reinforcing wires and carries an outwardly extending V-shaped nose that defines the spacing of the reinforcing mesh from the concrete mold wall, thereby positioning the reinforcement relative to the surface (inner, outer, or both) of the concrete structure. This spacer works quite well for fixed-spacing wire mesh, e.g., 2", 3", and 4" mesh, and has been successfully used with such reinforcement for many years. However, the more recent development of variable-spacing mesh, such as the spiral cages used in reinforced concrete pipe for example, has required the use of spacers that are capable of use with spacings of variable and numerous dimensions between wires.

A spring-wire spacer intended for use with variable-spacing wire mesh is described in U.S. Pat. No. 3,722,164, issued on Mar. 27, 1973. This spacer includes a serpentine part adapted to be engaged with the horizontal wire of the reinforcing mesh and two extension parts, one which protrudes outward from the serpentine part and acts as a spacing jack and the other which serves as a spring-loaded lever arm having a hook at its upper end to engage a vertical wire to clip the spacer on the mesh. Although not limited to a single-spacing mesh, this spacer has other disadvantages that impair its usefulness. One, the spacing jack terminates in a sharp end, which can damage the mold surfaces during fabrication and which, if extending through the concrete surface as sometimes occurs, can damage adjacent materials during shipment and can also result in injury to workmen during handling. Two, the spacing jack is a single wire protrusion extending at a right angle to the mesh. As a result, it can impede the placement of the mold over the wire mesh cage during fabrication and is also susceptible of being bent over. In the latter case, the jack no longer provides the proper positioning of the mesh relative to the mold surface. Also, the lever arm, which is gripped by hand during installation of the spacer, affords only the thickness of the spring-wire as a hand grip, and this can lead to difficulty and lost time in installation.

Another reinforcement spacer adapted for use with diverse mesh spacings is illustrated in U.S. Pat. No. 4,452,026, issued Jun. 5, 1984. In this spacer, two arms with oppositely facing hooks at their ends extend at right angles from a shank part and engage a mesh vertical wire on opposite sides. The upper end of the shank is looped over a horizontal wire, so that the upper arm extends from behind the vertical wire at its shank end to overlie the vertical wire at its hook end. The shank includes a U-shaped spacing projection which extends at a right angle to the plane of the mesh. A second portion of the shank connects the U-shaped projection to the lower arm and backs against the next adjacent horizontal wire to impart a torsional retention force to the spacer when the lower arm is snapped into position behind the vertical wire. While the spacer of the '026 patent avoids the problems attendant upon the use of a sharp-ended spacing projection, it still does not afford a secure handgrip for easy, error free installation. It additionally requires the use of the next adjacent horizontal wire as a backing wire for the torsion arm of the spacer. This could interfere with the installation of the spacer in those instances where the next adjacent wire is close to the lower arm. Also, the spacer has a rather complex configuration, which could lead to confusion and error in installation.

SUMMARY OF THE INVENTION

The foregoing and other disadvantages of the prior art are overcome by the provision of an improved reinforcement spacer for concrete structures which is formed as a unitary stiff, but resilient, member having an upper pigtail portion for engagement with one of a pair of intersecting reinforcement wires, a middle shank portion bearing a rounded spacing projection for engagement with the surface of a concrete mold, and a lower hook portion for engagement with the other of the intersecting pair of wires to securely clamp the spacer in place on the wire reinforcement. (The terms "upper" and "lower" are used here for convenience and clarity in describing the spacer and are not intended as limitations in the actual use or orientation of the spacer in practice.) The pigtail portion preferably extends to one side of the shank portion along an axis of curvature, or spiral, and is formed such that, when hooked over a mesh wire, the shank portion inclines away from the other intersecting mesh wire at a relatively small acute angle, e.g. on the order of ten to twenty degrees or so. The nose-like projection of the shank portion, in addition to its function of spacing the wire reinforcement from the concrete mold surface, also serves as a convenient gripping surface for ready installation of the spacer on the wire reinforcement. The worker need only grip the spacer by the nose-like projection, hook the pigtail portion over one of the intersecting wires, and then, without changing grip, swing the hook portion into engagement with the other wire by pushing on the nose-like projection.

As the spacer of the invention requires only one intersection of wires for installation, it is usable with all mesh or cage spacings. It is likewise adapted for use with all wire gauges. An added advantage in the latter respect is that, as wire gauge increases, the construction of the spacer is such that the retention force tending to hold the spacer in place on the wire reinforcement also increases. This means that the spacer will inherently provide higher retention forces in high-load applications, where heavy gauge reinforcement is typically used.

In a preferred embodiment, the spacer is formed of a single piece of spring steel wire that is bent to define the pigtail, shank and hook portions. The pigtail portion preferably includes a body portion that lies in a plane inclined at an acute angle to the shank axis and terminates in an upright end portion that bends upwardly out of the plane of the body portion. The shank portion is deformed adjacent its lower end to form the nose-like spacing projection. The upper leg of the projection slopes downwardly to facilitate the free flow of concrete over the spacer and to aid in guiding the vertical placement of molds over reinforcement cages. The lower leg of the nose-like projection merges into the hook portion, which itself is generally U-shaped and extends to the same side of the shank portion as does the pigtail portion. The U-shaped channel of the hook portion preferably opens back towards the shank portion so as to provide a secure clamping engagement with the other wire of the reinforcement.

BRIEF DESCRIPTION OF THE DRAWINGS

For a better understanding of the invention, reference may be made to the following description of a representative embodiment thereof and to the accompanying drawings, in which.

DETAILED DESCRIPTION

For purposes of illustration, a representative embodiment of the invention is described hereinbelow in the context of the manufacture of precast reinforced concrete pipe. It will be understood, however, that the invention is not limited to that particular use, but has general application to the positioning of wire reinforcement in concrete or other cast structures.

Figure 1:
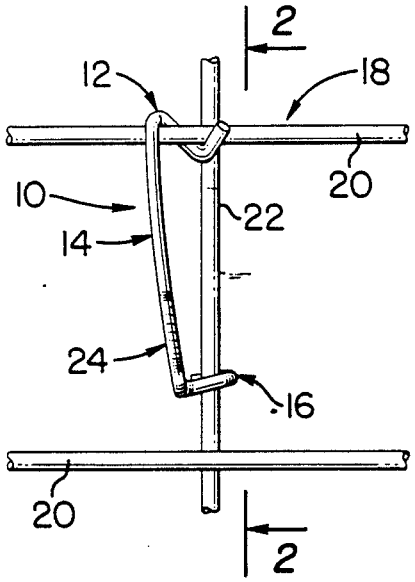
FIG. 1 is a front elevational view of a reinforcement spacer embodying the invention, shown in the installed position on a welded-wire mesh reinforcement.
Figure 2:
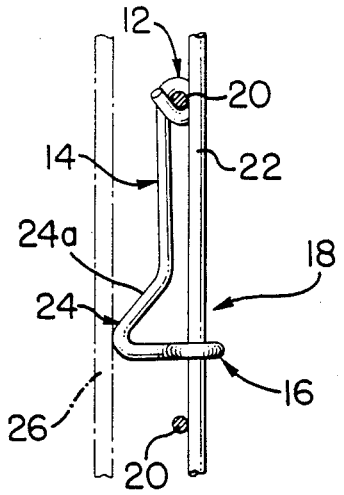
FIG. 2 is a side elevational view taken along the line 2—2 in FIG. 1 and looking in the direction of the arrows.

As shown in FIGS. 1 and 2, a reinforcement spacer 10 constructed in accordance with the invention is formed as a single, unitary member including, in general, a pigtail portion 12, a shank portion 14, and a hook portion 16. It is a feature of the invention that the spacer 10 may be economically fabricated as a simple wire form of a stiff but resilient material. For example, a high carbon hard drawn steel wire (e.g. C-1065) of approximately 0.150 inches diameter has been found satisfactory for the manufacture of small to medium size reinforced concrete pipe. Other materials and wire sizes may be used to suit the strength requirements of a given application.

The spacer 10 is illustrated in FIGS. 1 and 2 as installed on a welded-wire mesh reinforcement 18 formed by intersecting horizontal wires 20 and vertical wires 22 (only one of which is shown). As best seen in FIG. 2, the shank portion 14 is deformed at the lower end thereof (as seen in FIG. 2) as an outwardly and downwardly sloping spacing, or nose, portion 24 that is bent at its lower end along a radius of curvature to extend back towards the axis of the shank 14 and then merge into the hook portion 16. In the most commonly installed orientation, i.e., with the pigtail portion 12 at the top, the sloping upper leg **24*a* of the nose portion 24 serves to permit the free flow of concrete downward over the mesh or cage 18 without obstruction by the spacer 10. It also serves to guide the molds in those cases when they are put in place vertically over the mesh or cage 18. The extent of projection of the nose beyond the shank portion 14 defines the distance between the mesh 18 and the adjacent surface of the mold, shown schematically at 26 in FIG. 2**, for the concrete pipe.

The spacer 10 is depicted in FIGS. 1 and 2 as installed on a wire mesh or cage 18 in which the vertical wires 22 are on the inside of the horizontal wires 20. It is a feature of the invention that the spacer could be installed equally as well on a mesh or cage in which the horizontal wires are on the inside of the vertical wires. Similarly, the pigtail portion 12 could be hooked over a vertical wire 22 and the hook portion 16 engaged with a horizontal wire 20.

As may clearly be seen from FIGS. 1 and 2, the spacer 10 embodying the invention requires only one horizontal wire 20 and one vertical wire 22 for installation. Unlike certain prior art spacers, no backing wire is required to impart gripping force to the spacer. Similarly, there is no need for any specific spacing between adjacent horizontal wires 20. Thus, the spacer of the invention is adapted for use with all mesh spacings and with all wire gauges. No inventory of specially sized spacers is required for different mesh spacings or gauges. Of particular advantage is that the spacer of the invention is also useful with helical cages in which the circumferential wires and the vertical wires do not intersect at right angles and in which the spacing or pitch of the circumferential wires frequently is varied to meet reinforcing design specifications.

Figure 3:
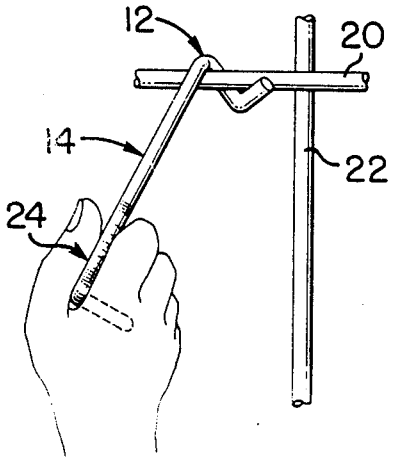
FIGS. 3, 4 and 5 are schematic views illustrating the steps involved in the installation of a reinforcement spacer embodying the invention on a welded-wire mesh reinforcement.
Figure 4:
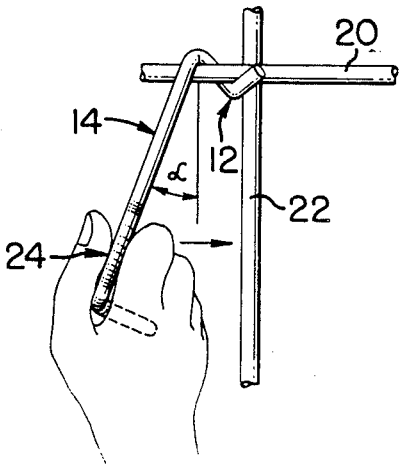
Figure 5:
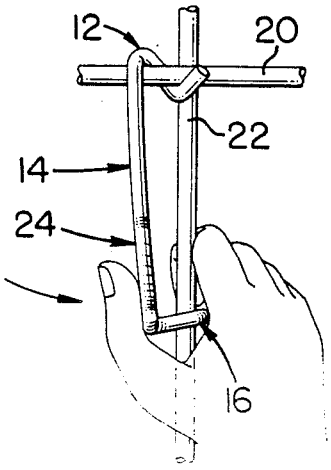

The manner of installation of the spacer 10 is illustrated in FIGS. 3, 4, and 5, from which further advantages of the invention will be apparent. As a feature of the invention, to install the spacer 10 the worker need only grip it at one point, namely the nose portion 24. By gripping the nose portion 24 between the thumb and forefinger with the shank portion 14 upright, the pigtail portion 12 may readily be slipped over a horizontal or circumferential wire 20, as shown in FIG. 3. The particular configuration of the pigtail portion, as described in more detail hereinafter, facilitates such placement of the spacer on the wire 20. The spacer 10 is then slid along the wire 20 until the pigtail portion 12 contacts the intersecting vertical cross wire 22, as indicated by the arrow in FIG. 4. Then, and without any need to change grip on the spacer 10, the spacer may be brought into secure clamping engagement with the wire mesh 18 by pushing the nose portion 24 in the direction of the arrow in FIG. 5 so as to move the hook portion 16 to the right (as seen in FIG. 5) and in behind the vertical wire 22. Although not clearly shown in FIGS. 3–5, the hook portion 16 defines a U-shaped channel 28 (see FIG. 8) which extends into the plane of FIGS. 3–5 and opens back towards the shank portion 14.

As will be appreciated, therefore, the nose portion 24 not only functions to position the wire reinforcement relative to the adjacent mold surface, but it also serves as a convenient handle by which the spacer may be gripped for installation. This handle function of the nose portion 24 has the very practical advantage of automatically aligning the spacer in the correct orientation for installation, thereby eliminating the time consuming fumbling and reorienting required with certain prior art devices. The nose also provides a relative broad gripping surface against which the worker can push when moving the hook portion 16 into engagement with the vertical wire 22 against the spring force of the spacer. This is to be contrasted with prior art spacers where only a single round wire is provided as a gripping surface.

The pigtail portion 12 is preferably oriented relative to the shank portion so that, when the portion 12 is engaged with the wire 20 and moved into contact with the wire 22, as shown in FIGS. 3 and 4, the shank portion 14 will be included at an angle $\alpha$ away from the vertical wire 22 (see FIG. 4). Then, when the nose portion 24 is pushed to the right as shown in FIG. 5, the shank portion 14 will pivot generally about the juncture between the shank portion 14 and the pigtail portion 12 and against the resilience of the material composing the spacer. This creates a spring force urging the hook portion 16 firmly against the vertical wire 22 and serves to secure the spacer on the mesh 18.

Figure 6:
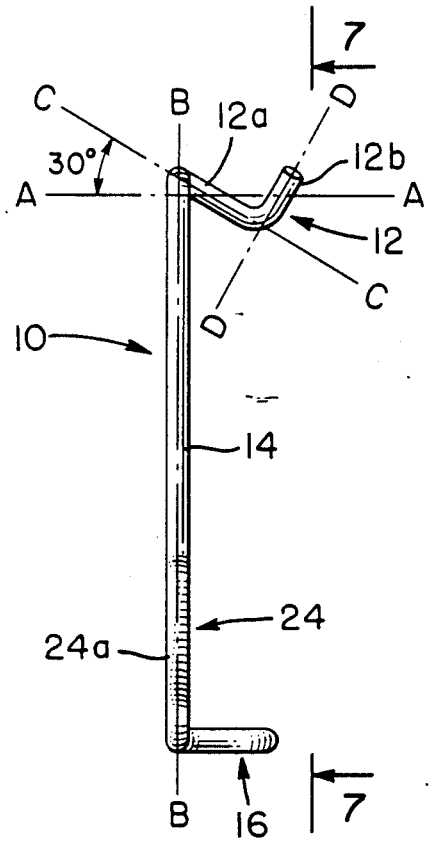
FIG. 6 is a front view of a reinforcement spacer embodying the invention.
Figure 7:
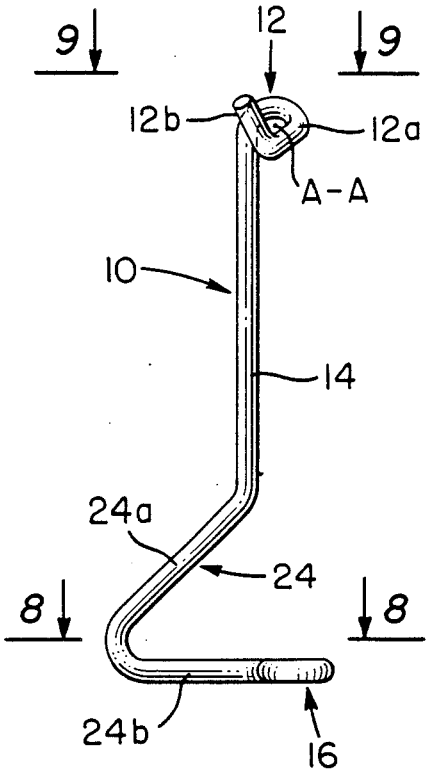
FIG. 7 a side view taken along the line 7—7 in FIG. 6 and looking in the direction of the arrows.

A preferred embodiment of the reinforcement spacer of the invention is depicted in more detail in FIGS. 6–9. As shown in FIGS. 6 and 7, the pigtail portion 12 preferably is formed along an axis of curvature, or spiral, A—A that extends to the right side of the shank 14 (as viewed in FIG. 6) at an angle of approximately ninety degrees to the plane extending normal to the drawing and containing the axis B—B of the shank portion 14. The pigtail portion 12 preferably has a spiral-like main body **12*a* which lies in a front-to-back plane (C—C) and terminates in an upright portion 12*b* extending along an axis D—D that preferably is approximately perpendicular to plane C—C. It has been found that an inclination of the plane C—C of the pigtail body 12*a* to the axis A—A of approximately thirty degrees (sixty degrees relative to the axis B—B of shank position) affords a suitable inclination of the shank 14 when the spacer 10 is installed on the mesh 18 in the manner of FIG. 4. The perpendicular orientation of the upright terminal portion 12*b* relative to the body 12*a* allows the pigtail end to bypass the inside cross wire 22 and creates a stop for positioning the spacer as shown in FIG. 4. When the mesh or cage 18 is reversed, the upright end 12*b* butts against the then outside vertical wire 22** and creates a stop.

Figure 9:
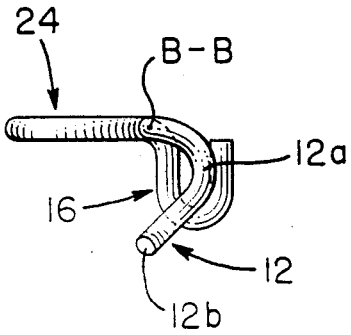
FIG. 9 is a sectional view taken along the line 9—9 in FIG. 8 and looking in the direction of the arrows.

The pigtail body portion **12*a*, as viewed from the side in FIG. 7 and the top in FIG. 9, curls backwardly, away from the nose portion 24, and to the right and then returns towards forwardly to approximately the axis B—B of the shank portion 14. For example, the upper tip of the pigtail portion 12*b* might lie approximately on the axis B—B. The curvature of the portion 12*a* should be sufficient to receive the reinforcing wire 20 when the spacer is looped over it in the manner illustrated in FIGS. 3–5. The upright pigtail portion 12*b* provides a bearing surface through which the force applied to the nose portion 24 and shank portion 14 is transmitted to the wires 20 and 22 during the final installation step (FIG. 5). This configuration of the pigtail portion 12 affords an easy and quick attachment of the upper part of the spacer 10** to a welded-wire mesh or spiral cage at any one welded wire intersection.

It will be understood that the specific angles for the pigtail body **12*a* and the upright terminal portion 12*b* given in connection with FIGS. 6 and 7 are not limiting, but may be varied from the values given. The object is to provide an inclination $\alpha$ of the shank 14 relative to the vertical wire 22 when the spacer 10 is in the position shown in FIG. 4 that will assure a sufficient resilient force to securely clamp the spacer on the mesh when the shank 14 is pushed to the right and engaged with the vertical wire 22 as shown in FIG. 5. At the same time, the inclination of shank 14 should not be so great as to require an unduly large installation force or to overstress the spacer material. For example, the aforementioned thirty degree inclination of the pigtail body 12*a* and the ninety degree orientation of the pigtail terminal projection 12*b* produces an approximately twelve degree inclination of the shank portion 14 relative to the vertical wire 22 when the spacer is attached in the position of FIG. 4 to a 0.162 inch diameter mesh wire. When attached to a 0.177 inch diameter mesh wire, the angle of inclination of the shank portion 14 is approximately sixteen degrees, and when attached to a 0.194 inch diameter wire the angle of inclination of shank portion 14 is approximately twenty degrees. As the mesh wire size increases, therefore, not only does the angular offset of the spacer shank portion 14 from the vertical wire increase, but so also does the force required to move the shank portion into engagement with the vertical wire. Consequently, the retention force holding the spacer in place on the mesh also increases. This is an advantage because heavier meshes are typically employed where larger loads are expected. The spacer 10** of the invention thus inherently provides a greater retention force for heavy load applications.

As shown in FIGS. 6, 7 and 9, the nose portion 24 comprises an outwardly deformed portion or section of the shank portion 14 which extends from the shank portion in the aforementioned plane normal to the drawing of FIG. 6 and containing the axis B—B of the shank 14. Thus, it may be seen from FIGS. 6 and 7 that the axis of curvature A—A of the pigtail portion 12 lies in the plane (vertical in FIGS. 6 and 7) which is generally perpendicular to the plane containing the nose portion 24 and generally parallel to the axis of elongate B—B of the shank portion 14.

Figure 8:
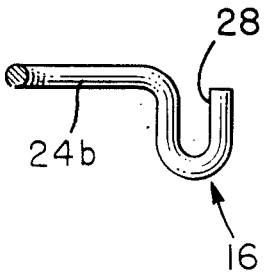
FIG. 8 is a vertical sectional view taken along the line 8—8 in FIG. 7 and looking in the direction of the arrows.

As seen in FIGS. 6–8, the hook portion 16 extends perpendicularly to the right (as viewed in FIG. 6) from the lower, horizontal leg **24*b* of the nose portion 24 and lies in the plane of the member 24*b*. The hook portion 16 preferably is U-shaped in plan view (FIG. 8) and opens to the left (as viewed in FIG. 6). Thus when the spacer 14 is moved as illustrated in FIG. 5 to the right of the vertical wire 22, the open U-shaped channel 28 of the hook portion 16 clamps over the wire 22 and securely locks the spacer in place on the wire mesh. The spring force of the spacer which results from pivoting the shank portion 14 about the juncture between the pigtail portion 12 and the shank portion 14 urges the hook portion 16 firmly against the wire 22, and the U-shaped configuration and leftward-facing orientation of the hook portion 16 serves to keep the spacer from slipping off the wire 22**.

As depicted in FIG. 9, the hook portion 16 and the pigtail portion 12 are preferably in generally overlying relation, so that an axis parallel to the shank portion 14 and passing through the center of the U-shaped channel 28 of the hook portion also passes through the curved region of the pigtail body 12*a*.

Although the invention has been described and illustrated herein by reference to a specific embodiment thereof, it will be understood that such embodiment is susceptible of modification and variation without departing from the inventive concepts disclosed. All such modifications and variations, therefore, are intended to be encompassed within the spirit and scope of the appended claims.

I claim:

1. A spacer for positioning in spaced relation to a surface a reinforcement mesh having welded intersecting wires, comprising a unitary member of stiff but resilient spring steel wire material, said member having a central shank portion having axis of elongation B—B and a spacing projection extending outwardly from said axis of elongation in a plane containing said axis of elongation for positioning engagement with said surface, a generally corkscrew-shaped pigtail portion at one end of said shank portion and extending to one side of said shank portion along an axis of curvature A—A for engagement, along said axis of curvature, with one wire of a pair of intersecting wires of the mesh, said axis of curvature A—A of said pigtail portion lying in a plane that is generally perpendicular to the plane of said spacing projection and generally parallel to said axis of elongation B—B, and a hook portion at the other end of said shank portion for engagement with the other wire of said pair of intersecting mesh wires, said pigtail portion being adapted to be engaged with said one mesh wire along said axis of curvature A—A and said shank portion being adapted to be pivoted towards said other mesh wire against the resilience of said spring steel wire material in order to bring said hook portion into engagement with said other mesh wire.

2. The spacer of claim 1 wherein said spacing projection terminates in a rounded portion for engagement with said surface.

3. The spacer of claim 2 wherein said spacing projection comprises an outwardly deformed section of said shank portion in which the member slopes outwardly relative to the axis B—B of the shank portion and in the direction away from the pigtail portion and is bent along a radius of curvature backwards towards the axis B—B of the shank portion and merges into said hook portion.

4. The spacer of claim 3 wherein said spacing projection functions, when said spacer is engaged with said mesh, to maintain the mesh in spaced relation to said surface.

5. The spacer of claim 4 wherein said deformed section slopes at an angle of approximately forty-five degrees to said axis B—B of the shank portion.

6. The spacer of claim 1 wherein said pigtail portion comprises a curved body portion lying in a plane C—C that is inclined at an acute angle to the axis B—B of the shank portion.

7. The spacer of claim 6 wherein said pigtail portion terminates in an upright end portion extending out of the plane of said curved body portion in the direction away from said shank portion.

8. The spacer of claim 7 wherein said upright end portion extends at an angle of approximately ninety degrees to the plane C—C of the curved body portion.

9. The spacer of claim 8 wherein the plane C—C of said pigtail body portion is inclined at an angle of approximately sixty degrees to the axis B—B of the shank portion.

10. The spacer of claim 1 wherein said hook portion extends to the same side of the shank portion as said pigtail portion and opens back towards the axis B—B of the shank portion for receipt of said other wire when the spacer is installed on the mesh.

11. The spacer of claim 10 wherein said hook portion is generally U-shaped and lies in a plane substantially perpendicular to the axis B—B of the shank portion.

12. The spacer of claim 10 wherein the pigtail portion and the hook portion are in general overlying relation to one another along an axis parallel to said axis B—B of the shank portion.

13. The spacer of claim 1 wherein said spacing projection is adapted to function as a handgrip for facilitating installation of the spacer on the mesh.

* * * * *

UNITED STATES PATENT AND TRADEMARK OFFICE

CERTIFICATE OF CORRECTION

PATENT NO. : 4,939,883

DATED : July 10, 1990

INVENTOR(S) : Richard A. Swenson

It is certified that error appears in the above-identified patent and that said Letters Patent is hereby corrected as shown below:

Title page, item (56)References Cited, U.S. Patent Documents, "3,400,792" should read --3,440,792--.

Column 3, line 46,"Fig 7" should read --Fig. 7 is --.

Column 6, line 55, "elongate" should read --elongation--.

Column 7, line 27, after "having" insert --an--.

Signed and Sealed this

Twenty-fifth Day of February, 1992

*Attest:*

HARRY F. MANBECK, JR.

*Attesting Officer*

*Commissioner of Patents and Trademarks*